US006912813B2

(12) United States Patent
Grizenko

(10) Patent No.: US 6,912,813 B2
(45) Date of Patent: Jul. 5, 2005

(54) FLASHING STRUCTURE

(76) Inventor: Paul Grizenko, 159 King'Road, Pointe-Claire, Québec (CA), H9R 4H5

( * ) Notice: Subject to any disclaimer, the term of this patent is extended or adjusted under 35 U.S.C. 154(b) by 39 days.

(21) Appl. No.: 10/300,470

(22) Filed: Nov. 20, 2002

(65) Prior Publication Data

US 2003/0121217 A1 Jul. 3, 2003

Related U.S. Application Data

(60) Provisional application No. 60/331,737, filed on Nov. 21, 2001.

(30) Foreign Application Priority Data

Nov. 20, 2001 (CA) ..... 2363360

(51) Int. Cl.[7] ..... E04D 3/38

(52) U.S. Cl. ..... 52/58; 52/94; 52/95; 52/302.6; 49/471

(58) Field of Search ..... 52/58, 60, 94, 52/95, 96, 287.1, 302.6, 204.1, 204.2, 204.53; 49/471, 506

(56) References Cited

U.S. PATENT DOCUMENTS

| | | | | | |
|---|---|---|---|---|---|
| 1,329,794 | A | * | 2/1920 | Moomaw | 52/531 |
| 1,685,524 | A | * | 9/1928 | Dow | 52/276 |
| 3,024,573 | A | | 3/1962 | McKinley | 50/66 |
| 3,264,790 | A | * | 8/1966 | Beals | 52/14 |
| 3,680,269 | A | | 8/1972 | Fischer, Jr. et al. | 52/94 |
| 3,925,952 | A | * | 12/1975 | Hagel et al. | 52/714 |
| 4,071,987 | A | | 2/1978 | Hickman | 52/94 |
| 4,241,549 | A | | 12/1980 | Hall, III et al. | 52/60 |
| 4,403,458 | A | | 9/1983 | Lolley | 52/60 |
| 4,434,590 | A | * | 3/1984 | Wheeler | 52/58 |
| 4,483,112 | A | * | 11/1984 | Rueblinger | 52/94 |
| 4,592,176 | A | | 6/1986 | van Herpen | 52/96 |
| 4,598,507 | A | | 7/1986 | Hickman | 52/94 |
| 4,780,999 | A | | 11/1988 | Webb et al. | 52/96 |
| 4,858,406 | A | | 8/1989 | Lane et al. | 52/300 |
| 5,022,207 | A | * | 6/1991 | Hartnett | 52/537 |
| 5,115,603 | A | | 5/1992 | Blair | 52/13 |
| 5,881,501 | A | * | 3/1999 | Guffey et al. | 52/90.1 |
| 5,927,023 | A | | 7/1999 | Kittilstad | 52/60 |
| 5,960,591 | A | | 10/1999 | Schlüter | 52/11 |
| 6,578,322 | B2 | * | 6/2003 | Kintop | 52/96 |

FOREIGN PATENT DOCUMENTS

| | | |
|---|---|---|
| CH | 279556 | 3/1952 |
| FR | 2275121 | 1/1976 |

* cited by examiner

*Primary Examiner*—Carl D. Friedman
*Assistant Examiner*—Nahid Amiri
(74) *Attorney, Agent, or Firm*—Collard & Roe, P.C.

(57) ABSTRACT

A flashing structure for mounting onto a roof surface and used for receiving shingles. The flashing structure includes a first drainage channel extending longitudinally along the flashing structure. The flashing structure also includes a securing lip positioned over the first drainage channel and extending along the same, a gap being defined between the securing lip and the first drainage channel, the gap being shaped and sized for receiving the shingles. The flashing structure also includes a second drainage channel extending longitudinally along the flashing structure, the second drainage channel being fluidly connected to the first drainage channel. These features can be adapted to various flashings used in the metal roofing industry, including, but not limited to gable-end flashings, end-wall flashings, and valley flashings, as well as other related flashing structures.

11 Claims, 16 Drawing Sheets

FLASHING STRUCTURE

FIELD OF THE INVENTION

The present invention relates to a flashing structure. More particularly, the present invention relates to a flashing structure used primarily but not exclusively for the installation of roofing shingles and roofing panels on residential and commercial property roofs.

BACKGROUND OF THE INVENTION

Metal roofing systems and the flashings used therewith, as well as the installing thereof, are very well known in the art. Indeed, as better shown in FIG. 1, it is customary to use metal flashings on the perimeter of a roof surface to reinforce and protect the same against wind damage and uplift, as well as to use flashings on roof edges and the transitions thereof to protect the same against water infiltration, for example. The flashings are generally supplied by the manufacturer of the roofing system, but can also be formed on site by the installers of the roofing system in order to adapt the flashings to the specific roofing situation at hand.

It is also well known in the art that over the years, flashing structures have evolved, partly driven by the economics of installation costs, partly driven by esthetic concerns, but mostly driven as a result and in response to failures of previous flashing structures, either due to wind damage and/or water infiltration, for example.

Known in the art are three main ways that a panel or shingle may be joined to a piece of flashing. Briefly explained, these three ways are the following: a) a folded shingle or panel over a lip of a flashing, as better shown in FIG. 2: b) the insertion of a shingle or panel into a groove or open lock in a flashing, as better shown in FIG. 3; and c) the insertion of a shingle or panel into a thin groove or slip-lock in a flashing, as better shown in FIG. 4.

Indeed, it is already common practice to create a first drainage channel or "gutter" on the flashing by adding a return bend (for example, a 180 degree bend), at the end of the flashing, underneath the shingle or flashing secured thereon, as better shown in FIGS. 3 and 4. This return bend is intended to prevent water in the gutter from moving from the flashing surface and onto the roof. However, this method is not fool-proof with the slip-lock type flashing shown in FIG. 4, for example, as debris often builds up in the crevice and the gutter, and consequently can cause blockage of the gutter and this result in the deflection of water onto the roof surface, which is very undesirable for obvious reasons.

The first two methods shown in FIGS. 2 and 3 are fairly reliable but require care and expertise by an installer in order to be properly performed. Namely, for the flashing illustrated in FIG. 2, the installer must trim the shingle or panel to typically provide an "overhang" of about 1.5 to 3 cm, which is then hand-bent over the lip and crimped, resulting in a fairly strong and relatively water-proof joint. When properly done, it results in a substantial even and clean appearance, and a fairly secure attachment to the supporting flashing. However, this type of flashing requires extensive training, experience and care from an installer in order to be properly installed, and thus may not be readily installed by a "do-it-yourself" person.

The flashing structure shown in FIG. 3 requires the shingle or panel to be inserted into an open lock channel, and trimmed in such a way that the shingle generally has a 90 degree bend, typically with a 1.5 to 2 cm riser, which then fills up the vertical gap, and touches the back of the open lock channel. Done properly, this type of flashing makes it very difficult for water to work its way around the riser and into the gutter. However, it has been found in the art that many installers do not take care to measure the riser properly, and/or inadvertently improperly measure the same, resulting in that the riser on the shingle is often too short and far from the back of the channel, thus allowing the water to easily move past the riser and into the channel, which is also very undesirable for obvious reasons.

The flashing structure of FIG. 4 is easier for an installer to install as it involves trimming the shingle so that it fits under the securing lip of the flashing, but often fails due to water infiltration as described in the preceding paragraph. This type of flashing is used by a number of manufacturers who claim that anyone with little or no roofing experience can install the system, but end up having to face frequent complaints by customers in regards to leakage, resulting from design and installation flaws of this type of flashing structure.

It is also known in the art that another issue that effects the integrity of a roofing installation is that the installers often do not measure carefully the amount of penetration of the shingle under the slip-lock of the flashing, with the result that some shingles that are "rough-trimmed" have very little material under the slip-lock. As a result thereof, in winter typically, when cold weathers cause contraction of the metal shingles, the shingles may pop out of the slip-lock, as well as be damaged by wind, snow, and/or ice, which is also very undesirable. In worst cases, such loose shingles may be blown away or swept off the roof surface and therefore result in severe damages to the roofing system, resulting in water infiltration and/or poor covering of the roof structure Also known in the art is the use of a valley flashing Which is typically used to protect the valleys of a roof, that is, two adjoining roof sections meeting on a slope. These valleys present the most amount of potential problems as this is where the water is typically concentrated, and where ice and/or snow can accumulate. Debris such as leaves, pine needles, and the like, often accumulate in these valleys and may cause water flowing off the roof to be diverted off course, thus resulting in leaks. The traditional practice in metal roofing has been to use "open" valleys, with built-in lips along both sides of the valleys to provide anchoring points and water deflection points for securing the shingles and/or flashings. However, to secure the shingles and/or panels to the valley in this manner requires extensive skill, specialized equipment and substantial time, thus resulting in considerable installation costs. Furthermore, it has been found in the art that many installers often try to "cut corners" and thus produce an end result which often leaks, which is also very undesirable.

Some companies have used "closed" valleys, which incorporate the slip-lock method of fastening the shingles, to speed up the installation, but they accumulate debris in the narrow junction between the shingles/panels and the lips of the flashing, and in winter they also ice up, causing water to overflow the drainage gutter and thus cause a leak, which is undesirable There are also valley flashing designs in existence which try to deal with the potential blockage of the pockets holding the ends of the shingles with a drainage system that directs the water to a central channel. These designs are typically of a two-piece construction, and the upper piece can be dislodged by the pressure and movement of ice and/or snow on the roof, causing the pocket holding the shingles to be lost.

Also known in the art are several documents describing different types of roofing systems and the flashing structures used therewith. Indeed, known to the Applicant are the following U.S. patent: U.S. Pat. No. 3,024,573 (McKinley); U.S. Pat. No. 3,264,790 (Beals); U.S. Pat. No. 3,680,269 (Fischer, Jr. et al.); U.S. Pat. No. 4,071,987 (Hickman); U.S. Pat. No. 4,241,549 (Hall, III et al.); U.S. Pat. No. 4,403,458 (Lolley); U.S. Pat. No. 4,592,176 (van Herpen); U.S. Pat. No. 4,598,507 (Hickman) U.S. Pat. No. 4,780,999 (Webb et al.); U.S. Pat. No. 4,858,406 (Lane et al.); U.S. Pat. No. 5,115,603 (Blair); U.S. Pat. No. 5,927,023 (Kittilstad); and U.S. Pat. No. 5,960,591 (Schlüter).

However, none of the above-mentioned documents seems to teach, illustrate or even suggest a flashing structure which overcomes the above-discussed prior art problems.

Hence, in light of the aforementioned, there is a need for an improved flashing structure which, by virtue of its design and components, would overcome some of the aforementioned problems.

SUMMARY OF THE INVENTION

The object of the present invention is to provided a flashing structure which satisfies some of the above-mentioned needs and which is thus an improvement over the flashing structures known in the prior art.

In accordance with the present invention, the above object is achieved by a flashing structure for mounting onto a roof surface and used for receiving at least one shingle, the flashing structure comprising:

a first drainage channel extending longitudinally along the flashing structure;

a securing lip positioned over the first drainage channel and extending along the same, a gap being defined between the securing lip and the first drainage channel, said gap being shaped and sized for receiving said at least one shingle; and a second drainage channel extending longitudinally along the flashing structure, said second drainage channel being fluidly connected to the first drainage channel.

According to another aspect of the present invention, there is also provided a flashing structure for mounting onto a roof surface and used for receiving at least one shingle, the flashing structure comprising:

a first drainage channel extending longitudinally along the flashing structure, the first drainage channel comprising a channel floor having opposite first and second longitudinal edges, the first and second longitudinal edges of the first drainage channel being each provided with a bend;

a first supporting lip being operatively connected to the channel floor of the first drainage channel via the bend provided on the second longitudinal edge thereof;

a securing lip operatively connected to the channel floor of the first drainage channel via the bend provided on the first longitudinal edge thereof, the securing lip being positioned over the first drainage channel and extending along the same, a gap being defined between the securing lip and the supporting lip, said gap being shaped and sized for receiving said at least one shingle;

a second drainage channel extending longitudinally along the flashing structure, the second drainage channel comprising a channel floor having opposite first and second longitudinal edges, the first and second longitudinal edges of the second drainage channel being each provided with a bend, the second drainage channel being fluidly connected to the first drainage channel; and a second supporting lip being operatively connected to the channel floor of the second drainage channel via the bend provided on the second longitudinal edge thereof, the second supporting lip being provided with a nailing flange According to another aspect of the present invention, there is also provided a flashing structure for mounting onto a roof surface and used for receiving at least one shingle, the flashing structure comprising:

a first drainage channel extending longitudinally along the flashing structure, the first drainage channel comprising a channel floor having opposite first and second longitudinal edges, the first and second longitudinal edges of the first drainage channel being each provided with a bend;

a first supporting lip being operatively connected to the channel floor of the first drainage channel via the bend provided on the second longitudinal edge thereof;

a second drainage channel extending longitudinally along the flashing structure, the second drainage channel comprising a channel floor having opposite first and second longitudinal edges, the first and second longitudinal edges of the second drainage channel being each provided with a bend, the bend provided on the second longitudinal edge of the channel floor of the second drainage channel being integral to the bend provided on the second longitudinal edge of the channel floor of the first drainage channel, the second drainage channel being fluidly connected to the first drainage channel; and a securing lip operatively connected to the channel floor of the second drainage channel via the bend provided on the first longitudinal edge thereof, the securing lip being positioned over the first drainage channel and extending along the same, a gap being defined between the securing lip and the bend provided on the first longitudinal edge of the channel floor of the first drainage channel, said gap being shaped and sized for receiving said at least one shingle.

According to yet another aspect of the present invention, there is also provided a flashing structure for mounting onto a valley of a roof surface and used for receiving at least one shingle, the flashing structure comprising:

a pair of first drainage channels extending longitudinally along the flashing structure;

a pair of securing lips, each of the securing lips being positioned over a corresponding first drainage channel and extending along the same, a gap being defined between each of the securing lips and said corresponding first drainage channel, each of the gaps being shaped and sized for receiving at least one shingle; and a pair of second drainage channels extending longitudinally along the flashing structure, each of the second drainage channels being fluidly connected to a corresponding first drainage channel.

According to yet another aspect of the present invention, there is also provided a roof comprising at least one flashing structure used for receiving a plurality of shingles, said at least one flashing structure comprising:

a first drainage channel extending longitudinally along the flashing structure;

a securing lip positioned over the first drainage channel and extending along the same, a gap being defined between the securing lip and the first drainage channel, said gap being shaped and sized for receiving shingles; and a second drainage channel extending longitudinally along the flashing structure, said second drainage channel being fluidly connected to the first drainage channel.

The objects, advantages and other features of the present invention will become more apparent upon reading of the following non-restrictive description of preferred embodiments thereof, given for the purpose of exemplification only with reference to the accompanying drawings.

DETAILED DESCRIPTION OF PREFERRED EMBODIMENTS OF THE INVENTION

Figure 1:
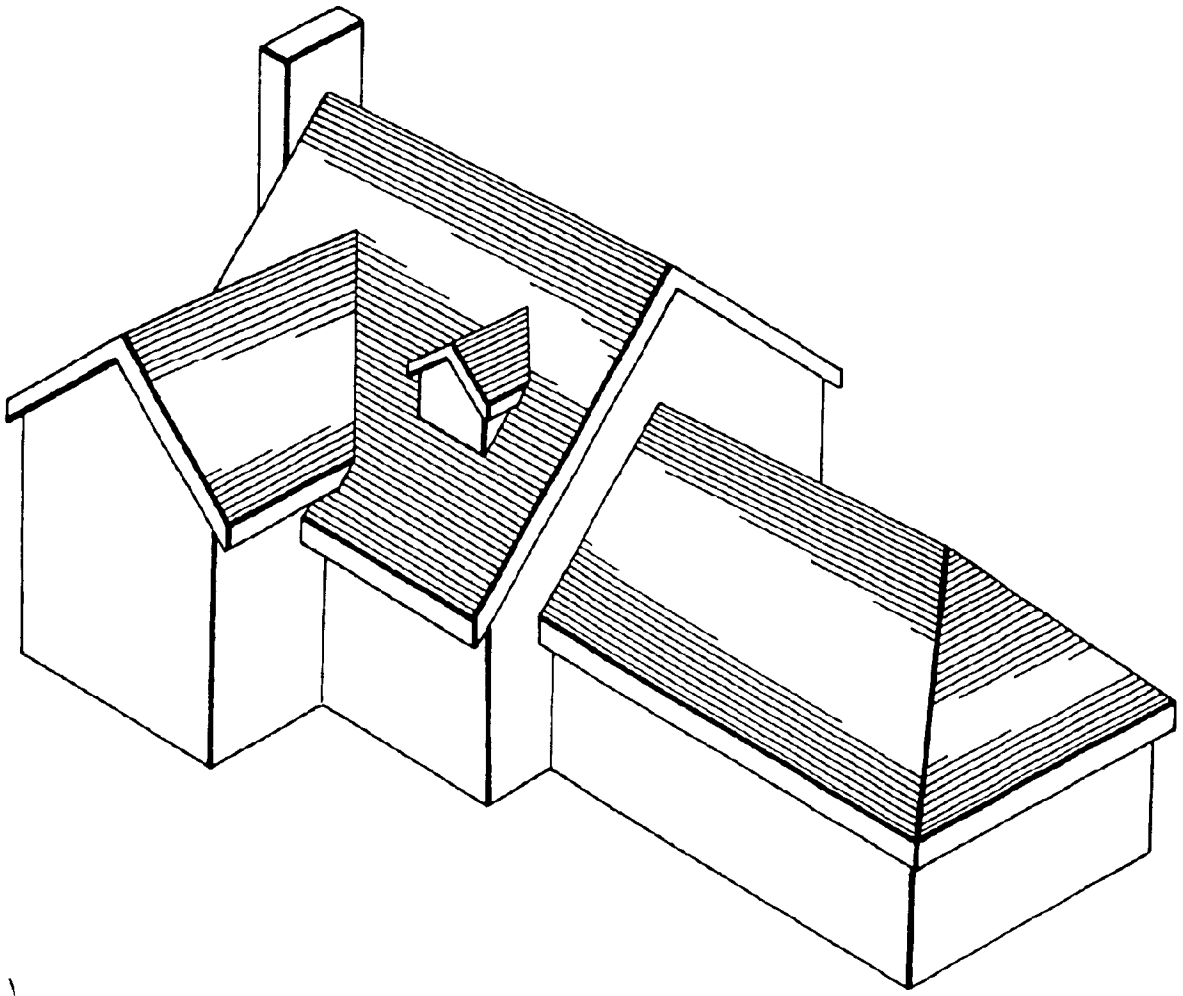
FIG. 1 (PRIOR ART)
FIG. 1 is a schematic perspective view of the various edges and transitions of a typical roofing system.
Figure 2:
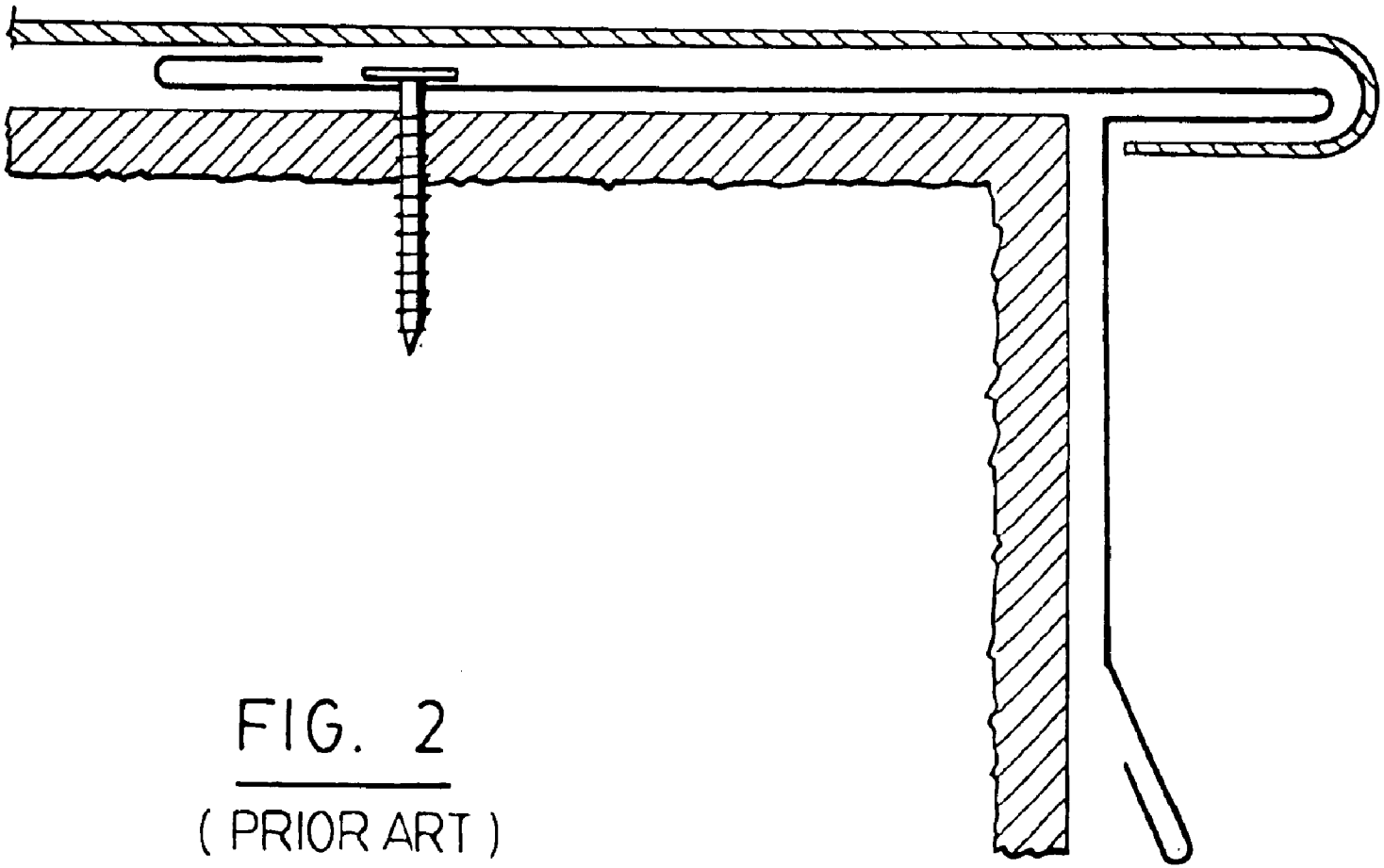
FIG. 2 (PRIOR ART)
FIG. 2 is a cross-sectional view of a flashing structure according to a first embodiment of the prior art, said flashing structure being shown mounted onto a roof structure and cooperating with a shingle.
Figure 3:
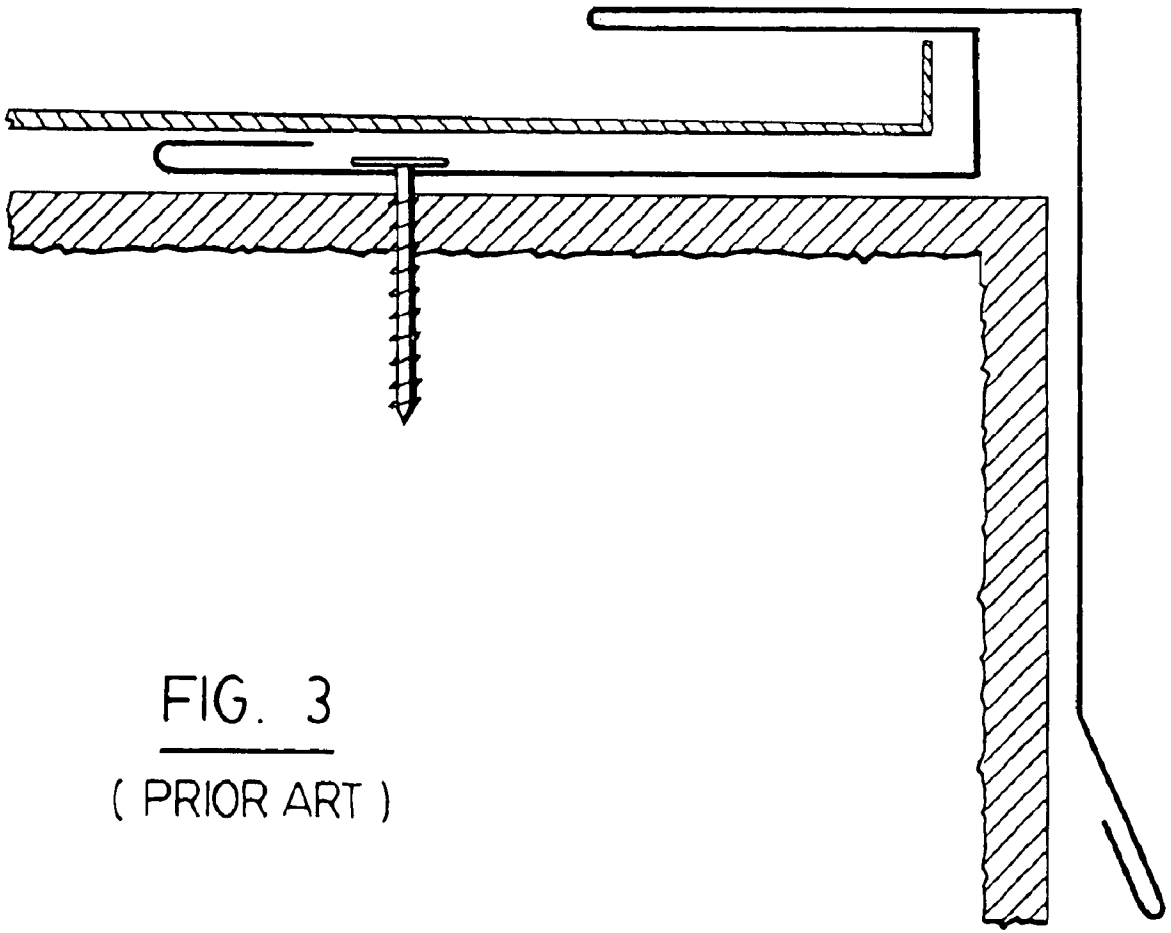
FIG. 3 (PRIOR ART)
FIG. 3 is a cross-sectional view of a flashing structure according to a second embodiment of the prior art, said flashing structure being shown mounted onto a roof structure and cooperating with a shingle.
Figure 4:
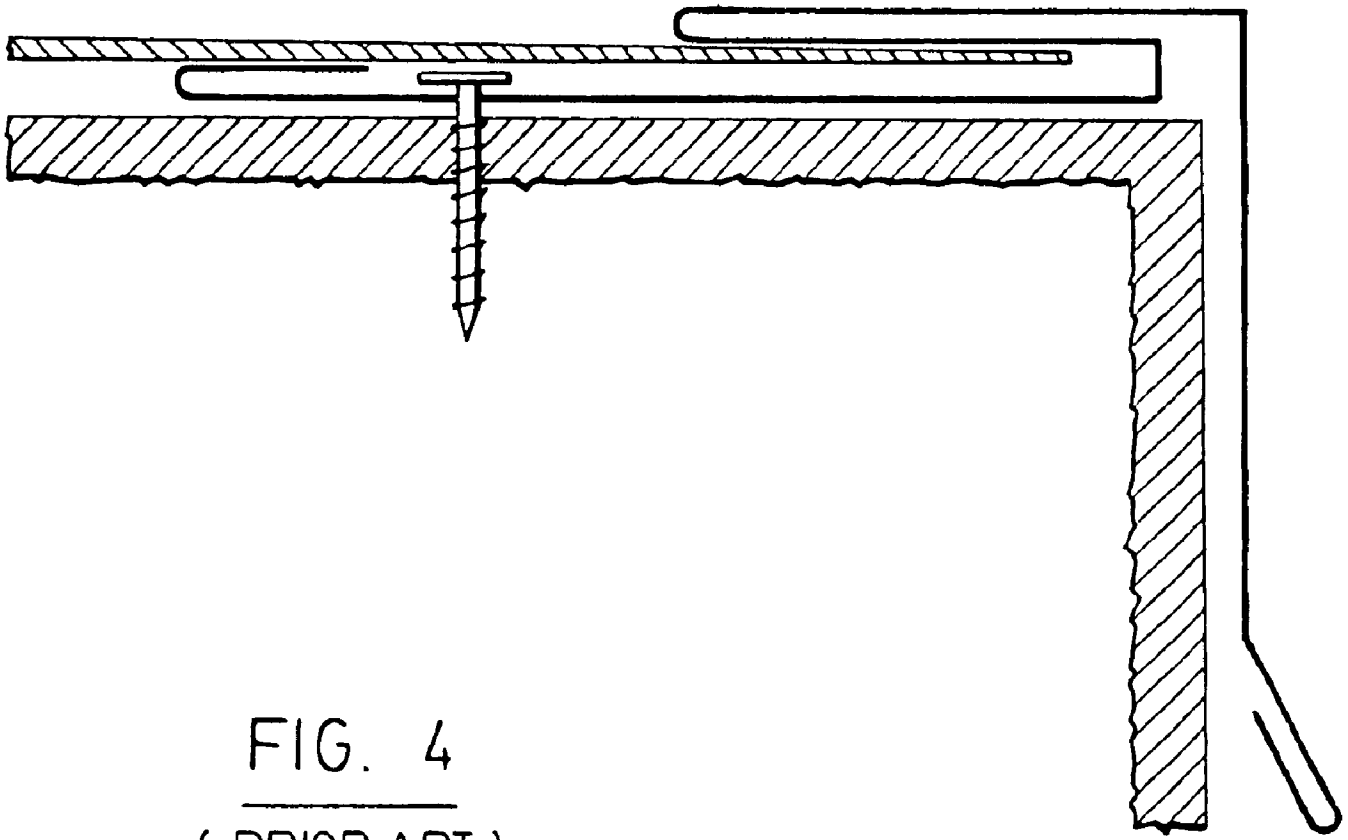
FIG. 4 (PRIOR ART)
FIG. 4 is a cross-sectional view of a flashing structure according to a third embodiment of the prior art, said flashing structure being shown mounted onto a roof structure and cooperating with a shingle.

In the following description, the same numerical references refer to similar elements. The embodiments shown in FIGS. 5–17 are preferred.

Moreover, although the present invention was primarily designed for use with a roofing system, it could be used in different fields for other purposes, as apparent to a person skilled in the art. For this reason, expressions such as "roof" and/or "shingle" and any other references and/or other expressions equivalent thereto should not be taken as to limit the scope of the present invention and include all other objects and all other purposes with which the present invention could be used and may be useful.

Moreover, although the preferred embodiments of the flashing structure 1 as shown comprises various components such as a return bend, first and second supporting lips, a nailing flange, an abutment flange, a rim, a drip-edge, etc., and although the preferred embodiments of the flashing structure 1 consists of certain geometrical configurations as briefly explained and illustrated herein, not all of these components and geometries are essential to the present invention and thus should not be taken in their restrictive sense, i.e. should not be taken as to limit the scope of the present invention. It is to be understood, as also apparent to a person skilled in the art, that other suitable components and cooperations thereinbetween, as well as other suitable geometrical configurations may be used for the flashing structure 1 and corresponding parts according to the present invention, as briefly explained herein and as can be easily inferred herefrom, without departing from the scope of the present invention.

Moreover, expressions such as "roof" and "surface", as well as any other equivalent expressions and/or compound words thereof, may be used interchangeably in the context of the present description. The same applies for any other mutually equivalent expressions, such as "shingle" and "panel" for example, as also apparent to a person skilled in the art.

Broadly described, the present invention as illustrated in the accompanying drawings is a flashing structure 1 for mounting onto a roof surface 3 and used for receiving at least one shingle 5. The flashing structure 1 comprises a first drainage channel 7 extending longitudinally along the flashing structure 1. The flashing structure 1 further comprises a securing lip 9 positioned over the first drain age channel 7 and extending along the same, a gap 11 being defined between the securing lip 9 and the first drainage channel 7, said gap 11 being shaped and sized for receiving said at least one shingle 5, as shown in FIGS. 5–17. The flashing structure 1 further comprises a second drainage channel 13 extending longitudinally along the flashing structure 1, said second drainage channel 13 being fluidly connected to the first drainage channel 7, as also shown in FIGS. 5–17. The flashing structure 1 is preferably made of a single piece and made of a single material, that is, as will be briefly explained hereinbelow, all the components of the flashing structure 1 are preferably made integral to one another. Preferably also, the flashing structure is shaped and sized for receiving a plurality of shingles 5 along the gap 11.

Thus, also broadly described, the present invention couples the ease-of-installation of a slip-lock method, and the convenience and strength of a single-piece flashing 1, with the creation of built-in drainage channels 7, 13, and a con figuration that minimizes the chance of debris clogging these channels 7, 13. There are different ways of creating such channels 7, 13, and some examples are illustrated in the accompanying drawings and are briefly explained hereinafter. In addition, as better shown in FIG. 5, the outside edge of the flashing 1 preferably has a hidden locking lip that, when hooked under a securing lock flashing, will prevent the potential failure of the flashing system by wind uplift. As a result of the above-mentioned innovative features, the present invention allows any do-it-yourself handyperson to install a roofing system without the need for specialized tools and/or training, and to achieve results comparable to those installed by trained professional installers.

The accompanying drawings show the main components and features of the flashing structure 1 according to the present invention. Since these features can be used in various types of flashings 1, the features are primarily discussed for one particular type of flashing 1 (e.g. gable-end), for sake of simplicity, with other variants and types of flashings 1 described briefly hereinbelow Indeed, as aforementioned, the features of the present flashing structure 1 can be used in various types of flashings 1, but the features of the present invention will be mainly discussed in reference to one general example, namely the gable-end type flashing structure 1, better illustrated in FIGS. 5 and 6, with other variants and types of flashings 1 according to the present invention shown in the subsequent figures. As well, it should be noted that each flashing type can be created in various ways, as for example by bending sheet metal on a brake, or by roll-forming the flashing 1, or by creating the flashing 1 by extrusion, or by any other suitable technique, as apparent to a person skilled in the art.

As aforementioned, the type of flashing 1 used to better illustrate the present invention is a "gable-end flashing" which is typically applied to the edge 15 of the roof (also known as the gable) and runs from the ridge to the cave along the roof 3. Its main purpose is to provide a secure anchor at the gable-end roof edge 15 to the shingles 5 and panels that cover the roof surface, and to divert any water that works its way around the shingles 5.

Figure 5:
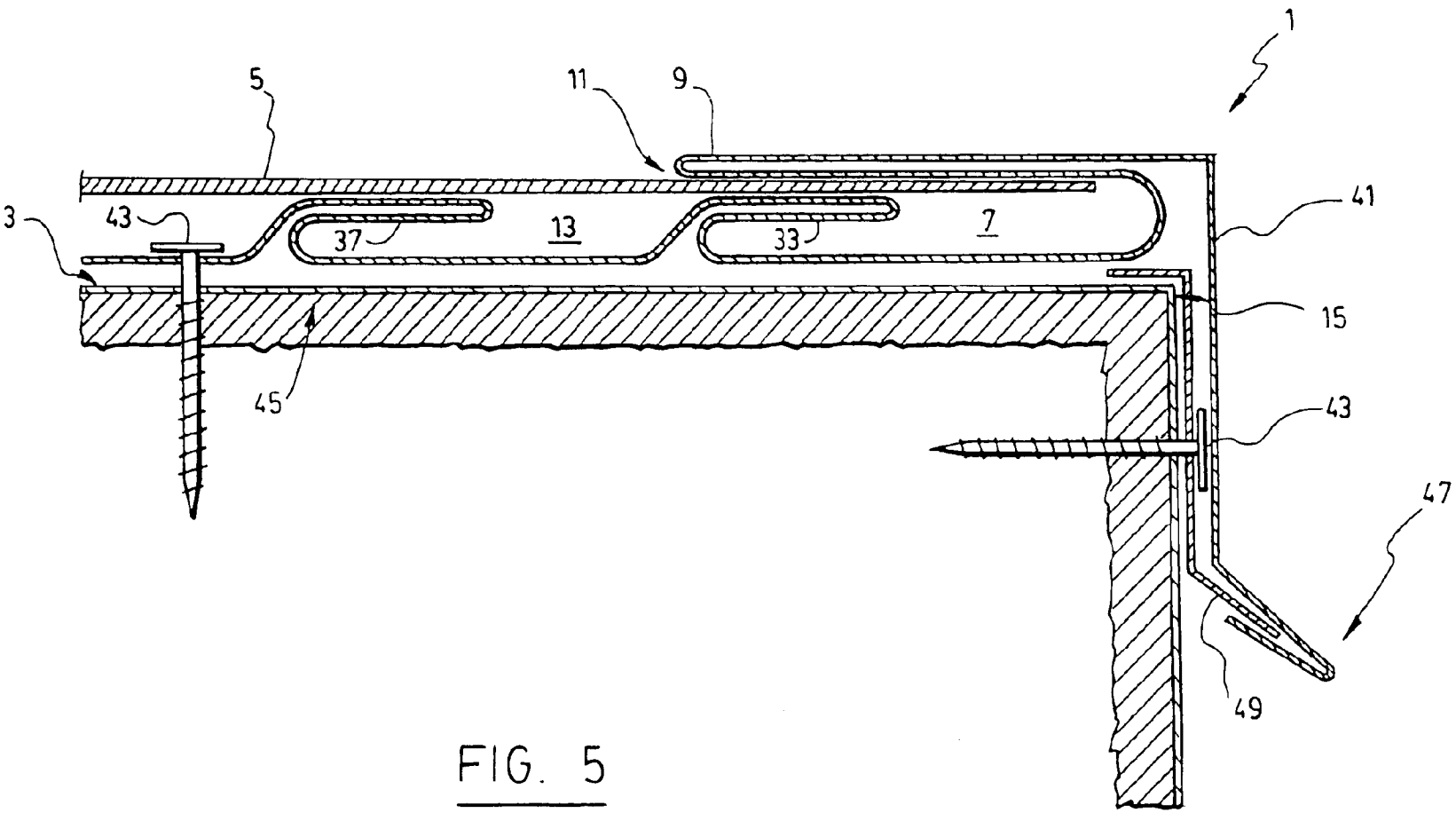
FIG. 5 is a cross-sectional view of a flashing structure according to a first preferred embodiment of the present invention, said flashing structure being shown mounted onto a roof structure and cooperating with a shingle.
Figure 6:
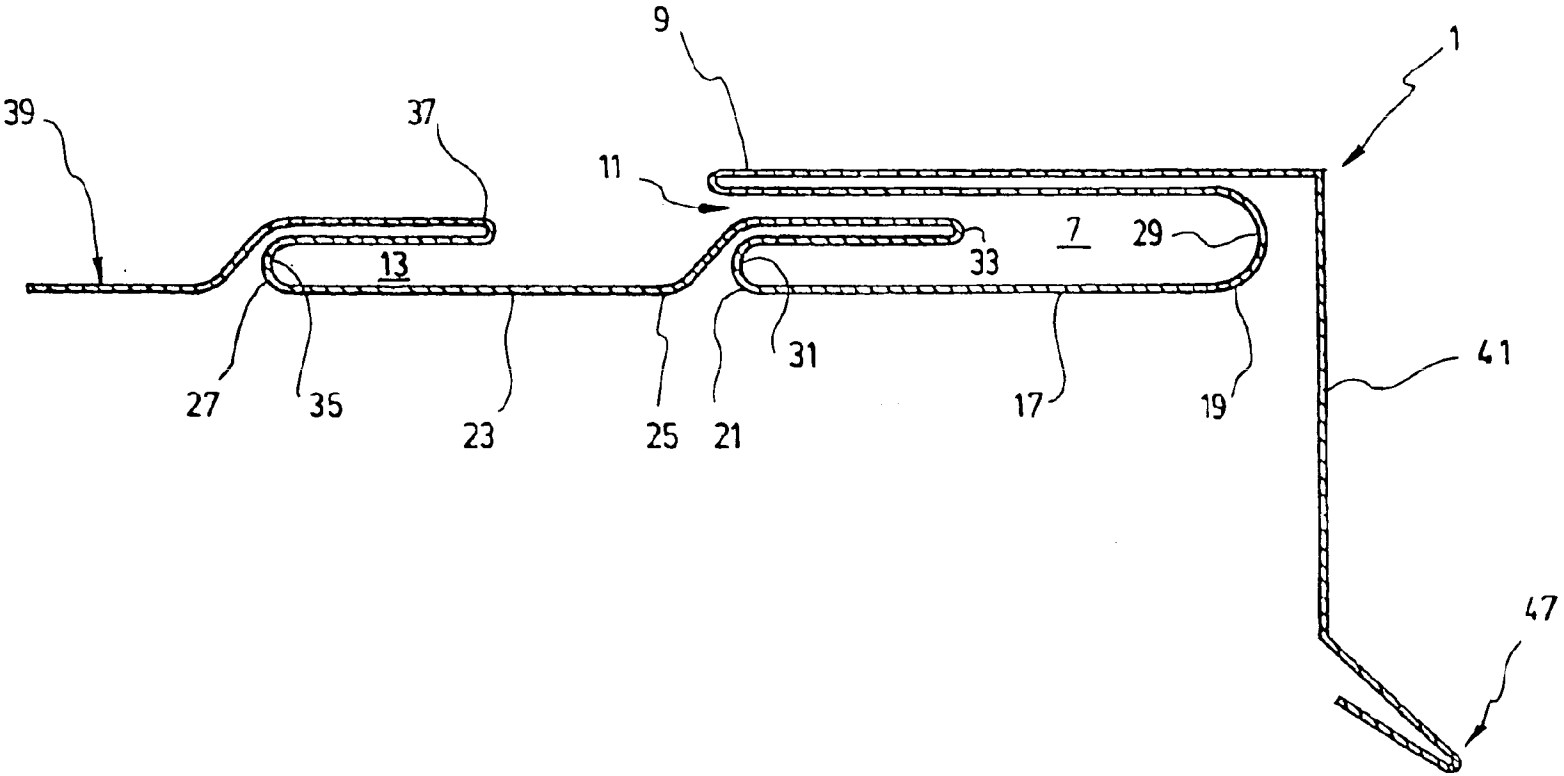
FIG. 6 is a cross-sectional view of the flashing structure shown in FIG. 5.

As better shown in FIGS. 5 and 6, the first drainage channel 7 preferably comprises a channel floor 17 having opposite first and second longitudinal edges 19, 21, and the second drainage channel 13 also preferably comprises a channel floor 23 having opposite first and second longitudinal edges 25, 27. Preferably, the primary drainage channel 7 cavity is sufficiently large to allow water to flow even if some debris makes its way past the shingle insertion point. The back portion of the primary hidden cavity is sufficiently high to allow adequate space for water drainage. Preferably also, the second drainage channel 13 acts as an overflow backup to the main first drainage channel 7, and is thus fluidly connected thereto.

Preferably, the first longitudinal edge 19 of the channel floor 17 of the first drainage channel 7 is provided with a bend 29, as better shown in FIG. 6. Typically, the distance between the channel floor 17 of the first drainage channel 7 and the securing lip 9 is selected so as to have suitable dimensions in order to have an appropriate drainage, as apparent to a person skilled in the art. Preferably also, the channel floor 17 of the first drainage channel 7 and the securing lip 9 are operatively connected to one another via the bend 29. Preferably also, the second longitudinal edge 21 of the channel floor 17 of the first drainage channel 7 is provided with a bend, and this bend 31.

As better shown in FIG. 6, the flashing structure 1 preferably further comprises a first supporting lip 33, said first supporting lip 33 being operatively connected to the channel floor 17 of the first drainage channel 7 via the bend 31 provided on the second longitudinal edge 21 thereof. Preferably, it is typically formed to be a very tight bend. This supporting lip 33 has the dual role of supporting the inserted shingle 5, holding it tightly against the upper lip 9, and at the same time leaving a cavity which allows drainage of water.

Preferably also, the second longitudinal edge 27 of the channel floor 23 of the second drainage channel 13 is provided with a bend 35, and the flashing structure 1 preferably comprises a second supporting lip 37, said second supporting lip 37 being operatively connected to the channel floor 23 of the second drainage channel 13 via the bend 35 provided on the second longitudinal edge 27 thereof, as also better shown in FIG. 6. This bend 37 is also typically very tight, and has two main functions: to hold the shingle 5 away from the underlying drainage channel 13, in order to keep enough space to allow the cavity to be formed and to push shingle 5 up against the slip-lock lip 9 so that the gap 11 be as small as possible.

As illustrated in FIGS. 5 and 6, the first longitudinal edge 25 of the channel floor 23 of the second drainage channel 13 is preferably operatively connected to the second longitudinal edge 21 of the channel floor 17 of the first drainage channel 7 via the first supporting lip 33.

Preferably also, the second supporting lip 37 is provided with a nailing flange 39, and the securing lip 9 is provided with an abutment flange 41 projecting perpendicularly therefrom. As better shown in FIG. 5, a fastener 43, such as a nail, a screw, a clip, or the like, is inserted through the nailing flange 39 and into the roof sheathing 45 for securing the flashing structure 1 onto the roof surface 3. This sheathing 45 may be covered by membrane or underlayment.

In the case of a gable-end type flashing 1. as better shown in FIGS. 5 and 6, the abutment flange 41 preferably projects downwardly and is preferably provided with a longitudinal drip-edge 47, said longitudinal drip-edge 47 being removably connectable onto a corresponding hook 49 provided on a side edge of the roof surface 3. In the gable-end flashing 1, the abutment flange 41 is the part covering the fascia of the gable-end or rake. The drip-edge 47 directs water away from the fascia.

Figure 7:
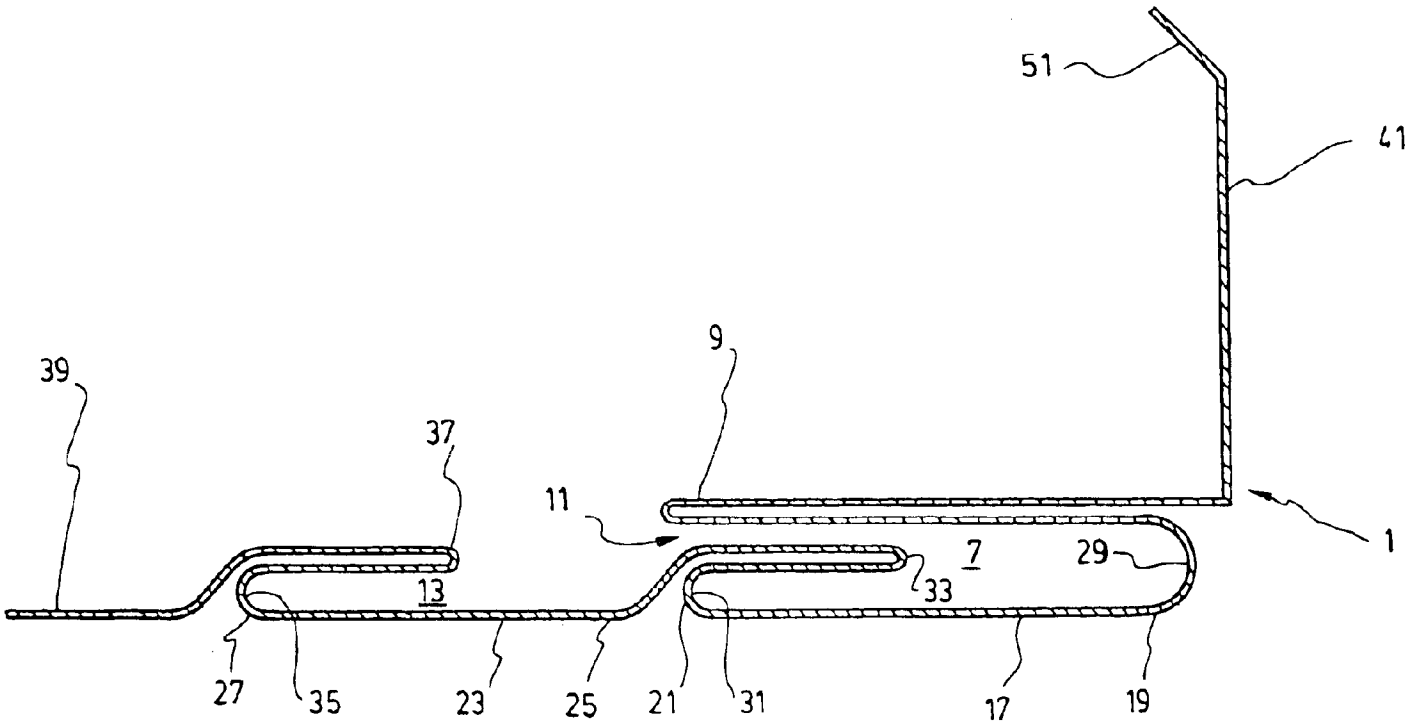
FIG. 7 is a cross-sectional view of a flashing structure according to another preferred embodiment of the present invention.

In the case of an end-wall type flashing 1, as better shown in FIG. 7, the abutment flange 41 preferably projects upwardly and may be provided with a longitudinal rim 51, when the flashing structure 1 is employed as an end-wall flashing 1.

The gable-end flashing 1 shown in FIG. 5 is the same as in FIG. 6, and also shows how the flashing 1 is positioned on the roof edge 15. This flashing 1 is preferably secured in two ways: a nail through the nailing flange 39 portion of the flashing 1 secures the flashing 1 to the roof sheathing 45, and the drip-edge 47 which is held by the lip of the securing flashing 15, which in turn is preferably nailed to the fascia with a nail 43. Once the flashing 1 is secured in this manner, it becomes a strong point of anchoring the shingles 5.

Preferably, the shingle 5 is cut so that it fits under the slip-lock, and enters the flashing at gap 11. The shingle 5 extends preferably under the slip-lock all the way to the back of the channel 7, preferably at a suitable distance past the insertion point. It should be clear that if the installer has not trimmed the shingle 5 carefully, as long as it is inserted at an appropriate minimal distance, under the slip lock lip 9, there will be little possibility of the shingle 5 popping out later, as apparent to a person skilled in the art. The extra margin of error that a wide slip-lock affords the installer allows for easier and quicker installation.

One aspect which is important to the invention is that once the shingle 5 is inserted into the slip-lock lip 9, there is very little space between the shingle 5 and the slip-lock lip 9 to allow the entry of roof debris. A second important element of the invention is that any debris that does manage to work its way into the flashing 1 between the shingle and the slip-lock, will find itself in the primary drainage cavity 7, which is designed to be large enough to allow rain to wash out the debris. Compared to the current state of the art, this combination of features allows for a much more reliable flashing 1 from the point of view of protecting the roof from water infiltration.

Indeed, as a precaution, there is the secondary drainage channel 13 which is intended to act as a backup in the event the primary drainage channel 7 overflows. The lip 37 forming it is designed to push up against the inserted shingle 5, so that it makes a tight fit with the slip-lock lip 9, as better shown in FIG. 5, and also creates a drainage cavity large enough to drain water. This is another important aspect of the invention in the sense that it creates a specific configuration of elements which act together to achieve the purpose of the invention. The securing lip 9 is the slip-lock which holds the shingle in place. It is designed to be very close to or even touching the primary channel lip 33. With the shingle 5 inserted into under this lip 9, there will be very little space available to allow the entry of debris, as can be easily understood. This is the point at which the shingle 5 is held by the lip 9 of the slip-lock. Note that the shingle 5 is expected to extend to the back of the primary drainage cavity. The actual opening is designed to be very tight to prevent the debris from entering the internal hidden drainage channels.

As can be easily understood, the wide securing lip 9 of the slip lock allows an installer to trim the shingle 5 approximately (as opposed to precisely), and the lock will still secure the shingle 5. This allows an installer to work quickly and to use only basic tools (such as snips and a hammer for example) to carry out the installation.

Since the slip-lock will still trap debris, the addition of the secondary drainage channel 13 provides for a water outlet that avoids water buildup in the hidden gutter which can overflow the return.

At the outside edge, it is traditional practice to secure the fascia portion of the flashing with a few finishing nails. However, in high wind situations, these often do not provide sufficient holding power against wind uplift, and wind damage can occur. Hence, the addition of a hidden securing flashing which can be held by many nails (typically, one nail every 6 inches) according to the present invention provides for a much more secure fastening method, without the unsightly marks using nails can create, as better shown in FIG. 5.

There are several flashing types in which the present invention may be integrated. The gable-end flashing 1 has been briefly described hereinabove. The other two common flashing types are the end-wall flashing 1 and the valley flashing 1.

Indeed, as explained earlier, an end-wall flashing is used to protect the junction between the roof and a wall. It is the current practice to use either the full-lock or the slip-lock methods of securing the shingles 5 with these flashings. According to the prior art, the full-lock takes time, skill, and special tools to perform correctly, and therefore is often not done to the required standard. The slip-lock is installed quickly, but has problems with water diversion and backup.

In contrast, the incorporation of the features according to the present invention into the end-wall flashing 1, as better shown in FIG. 7, creates hidden drainage channels 7, 13 in the slip-lock form of the flashing 1 allowing for both fast and easy installation, and assurance that water diversion caused by either debris accumulation, or icing conditions does not occur.

In the end-wall flashing 1 shown in FIG. 7, the abutment flange 41 is the portion of the flashing 1 that runs up the wall, either underneath the siding on the wall, or over the wall covering. The rim 51 is designed to hold a caulking bead if the flashing 1 is installed on the outside of the wall covering.

Figure 8:
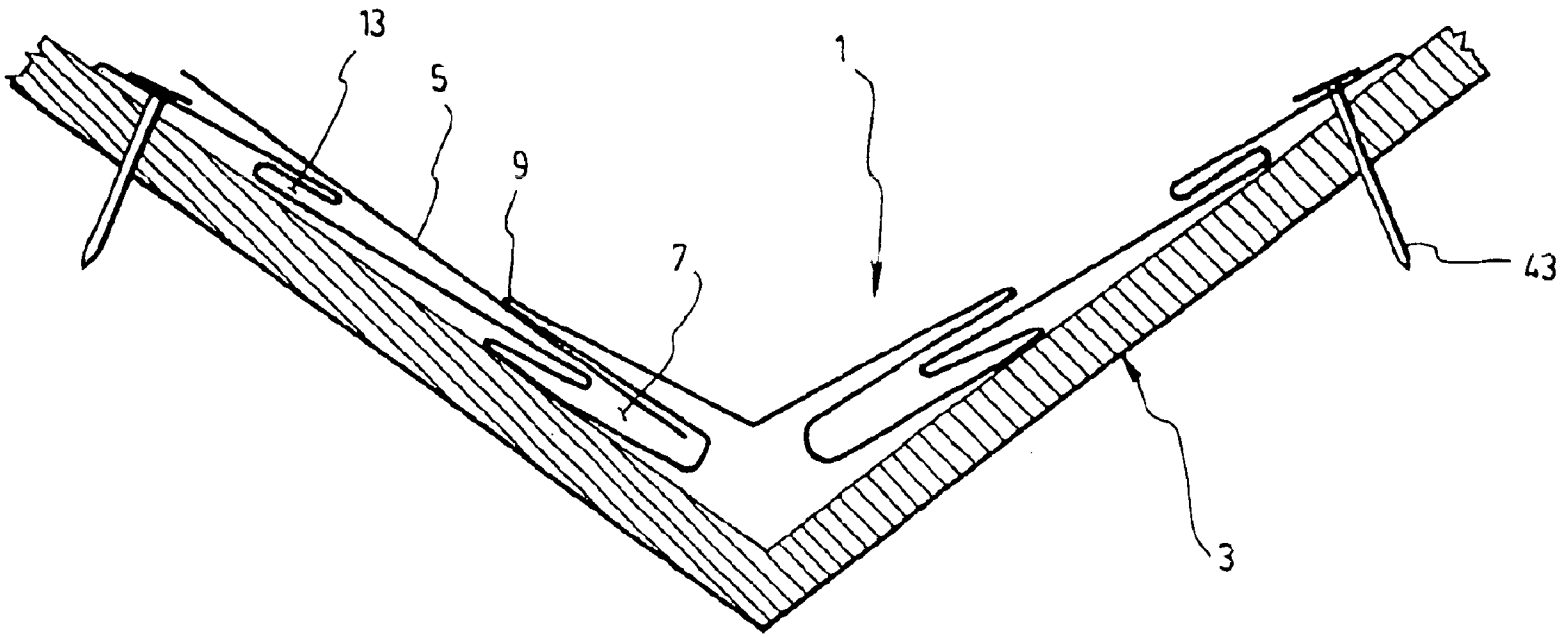
FIG. 8 is a cross-sectional view of a flashing structure according to yet another preferred embodiment of the present invention, said flashing structure being shown mounted onto a valley and cooperating with a shingle.
Figure 9:
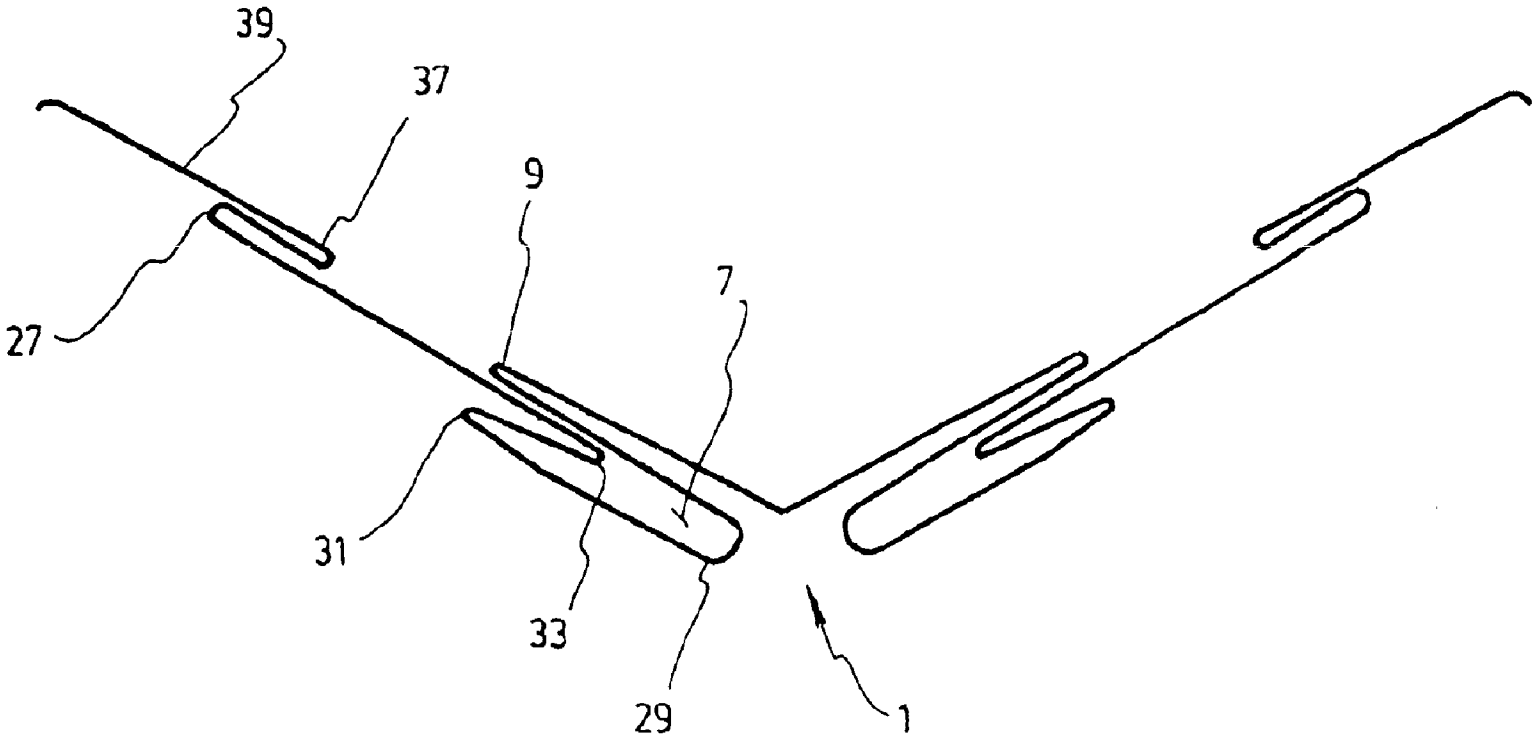
FIG. 9 is a cross-sectional view of the flashing structure shown in FIG. 8.
Figure 10:
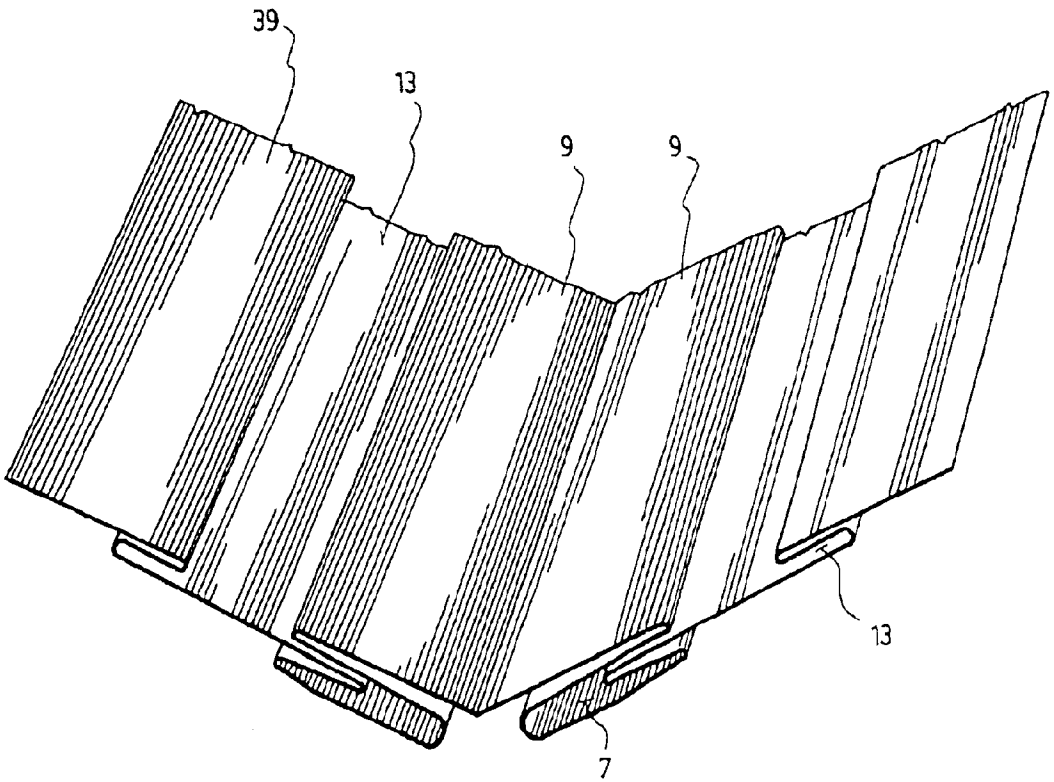
FIG. 10 is a perspective view of the flashing structure shown in FIG. 9.

FIG. 8 shows a flashing structure 1 according to another embodiment of the present invention, the flashing structure 1 being now used as a valley flashing 1. FIG. 8 illustrates the attachment nails 43 of the flashing 1 to the roof 3, and the location of the shingle 5 which is inserted into the slip-lock at point. Note that the shingle 5 is held away from the bottom of the flashing 1 by the lips, allowing the drainage channels to function, and tight fit of sliplock lip 9 against the shingle 5 minimizes the entry of debris.

Another point worth noting is that even if there is strong pressure by snow or ice against the slip-lock lip either laterally or vertically, the hidden channel will continue to function.

When expressed in the form of the valley flashing, as shown in FIGS. 8–11, it is clear that the slip-lock which forms the roof of the primary drainage channel 7 will maintain its integrity even when subjected to the pressure of accumulated snow and ice. Unlike the prior art where two separate components are generally used to deal with the water flow and avoiding the problems caused by debris accumulation, the pressure and movement of snow and ice does not create a failure point by allowing the two components to be separated. By constructing the valley flashing 1 as a single integral component, and by using the configuration of elements, this valley flashing 1 deals with the issues of water flow, debris accumulation, potential lack of skill of installers, pressure by ice and snow accumulation in a reliable and effective manner, allowing this type of flashing 1 to be used by relatively inexperienced workers, while still delivering professional results.

As a practical matter, flashings are usually produced in 8-foot or 10-foot lengths, and often have to be joined together to cover roof sections that are greater than 10 feet in length. To allow the different sections to be joined without creating a potential leakage point, one end of each section is preferably made somewhat wider, so that an adjacent section can slip into it with an appropriate distance overlapping, so that water running down the drainage channel in the higher section finds itself in the drainage channel of the lower section at the junction point. This wider part of the flashing 1 is referred to as the "female" end, and is better shown in FIG. 11.

Indeed, sections of flashings 1 are typically no longer than 10 or 12 feet, and have to be joined together if the section of roof 3 to be protected by the flashing 1 is longer than this. Due to the presence of the built-in channels 7. 13, the present invention also covers the method of joining the different sections of flashings 1 to allow a leak-proof installation.

Figure 11:
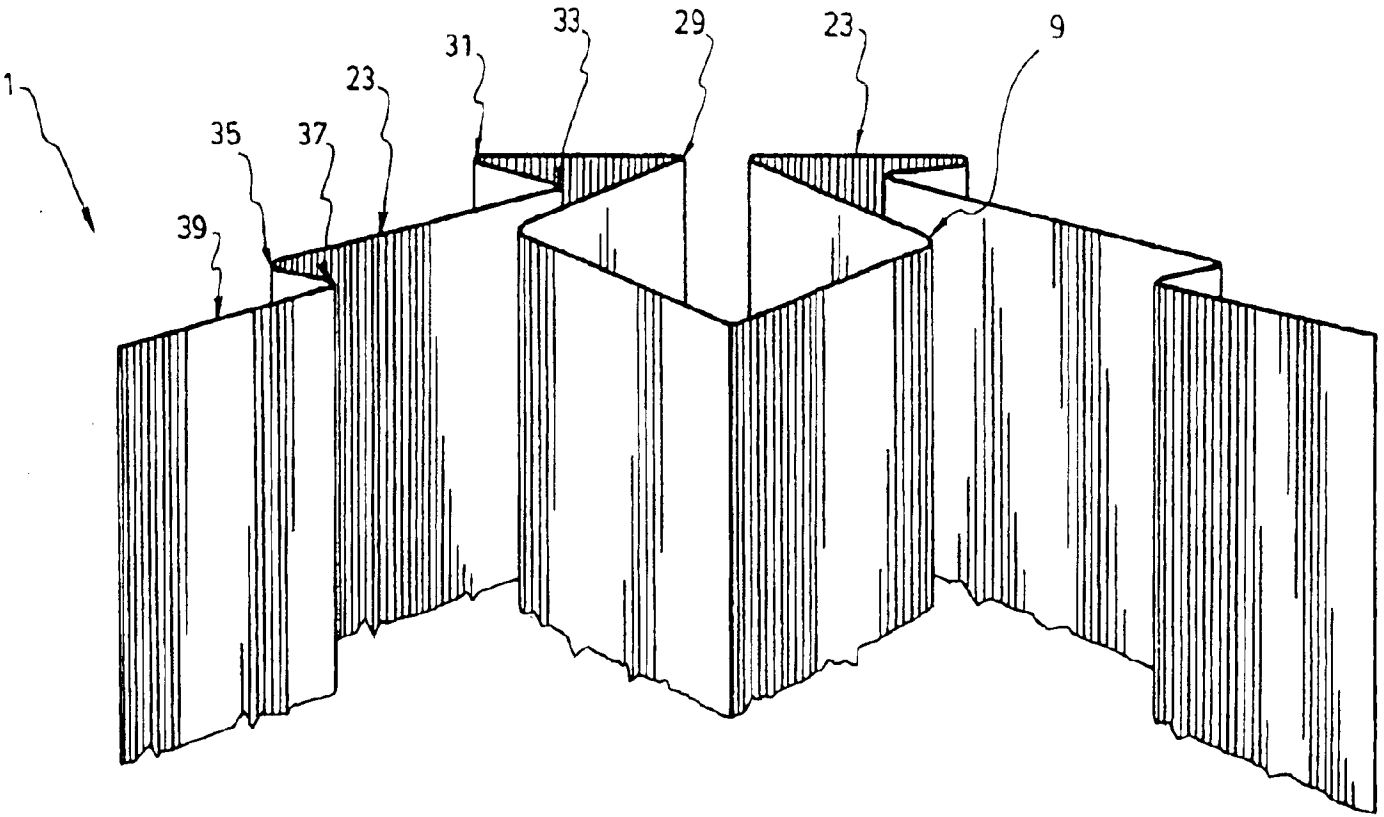
FIG. 11 is a perspective view of a female component of the flashing structure shown in FIG. 10.

FIG. 11 illustrates the "female" end of the valley flashing 1 and illustrates the tapered shape needed to allow two sections of flashings 1 to be joined. The "male" end of the flashing 1 is preferably cut straight across (not tapered), and the two primary drainage channels are inserted into the corresponding female ends first. Next, the flashing surface formed by the exposed part of the valley of the "male" end is slipped over the corresponding surface on the "female" end, and finally the lips forming the secondary drainage channel on the "male" end are slipped into the cavity on the "female" end. This configuration allows any water in the upper part of the flashing 1 (above the joint) to drain directly into the corresponding drainage channels in the lower flashing 1 (below the joint), as apparent to a person skilled in the art.

Figure 12:
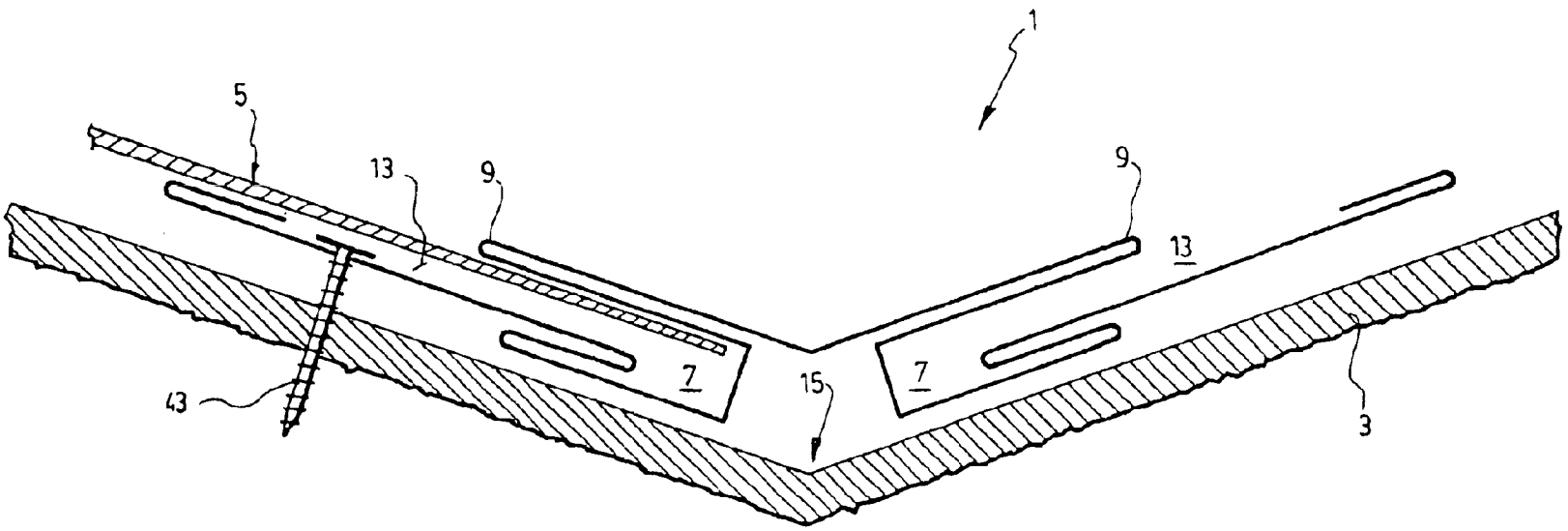
FIG. 12 is a cross-sectional view of a flashing structure according to yet another preferred embodiment of the present invention, said flashing structure being shown mounted onto a valley and cooperating with a shingle.
Figure 13:
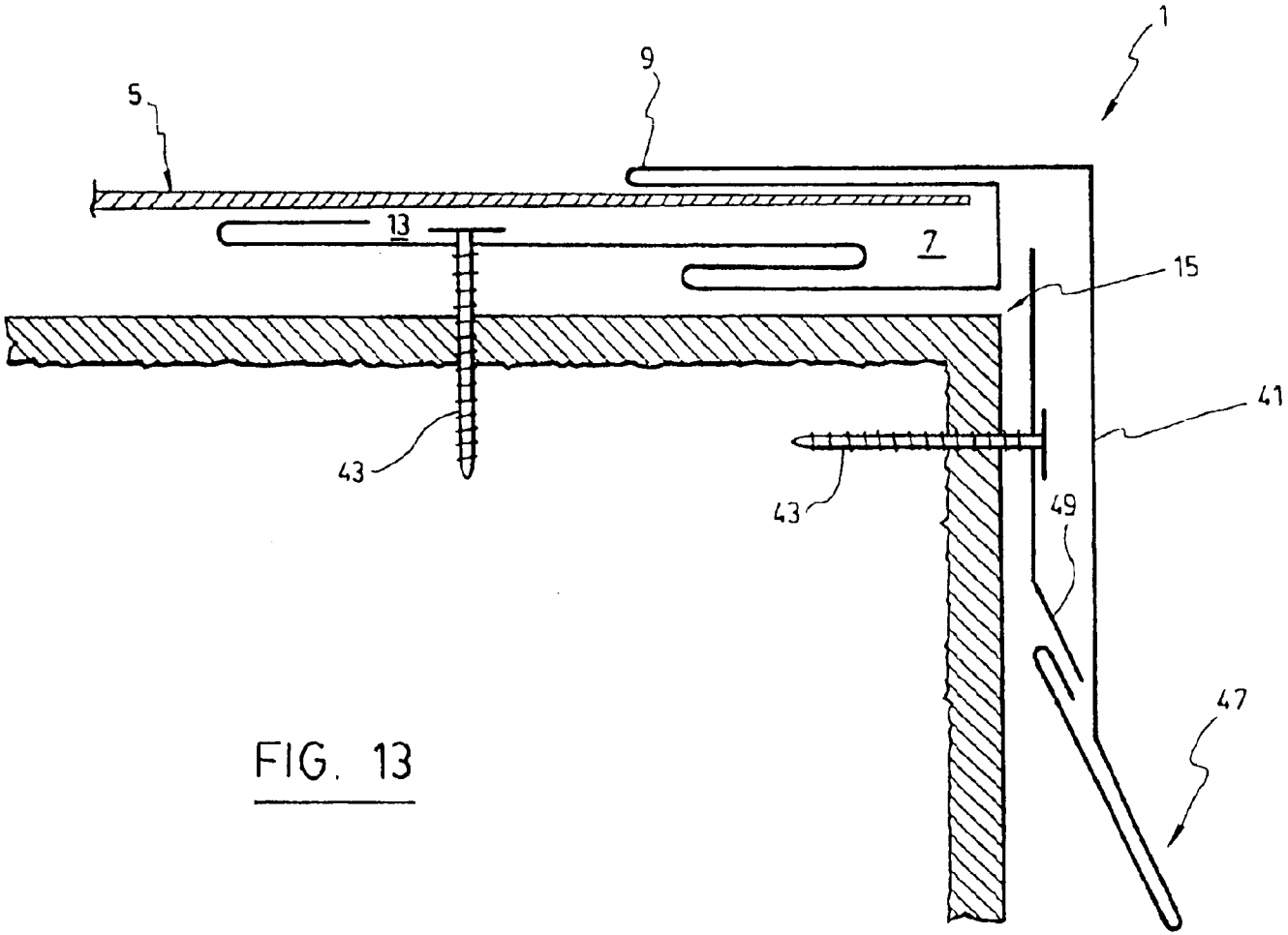
FIG. 13 is a cross-sectional view of a flashing structure according to yet another preferred embodiment of the present invention, said flashing structure being shown mounted onto a roof structure and cooperating with a shingle.
Figure 14:
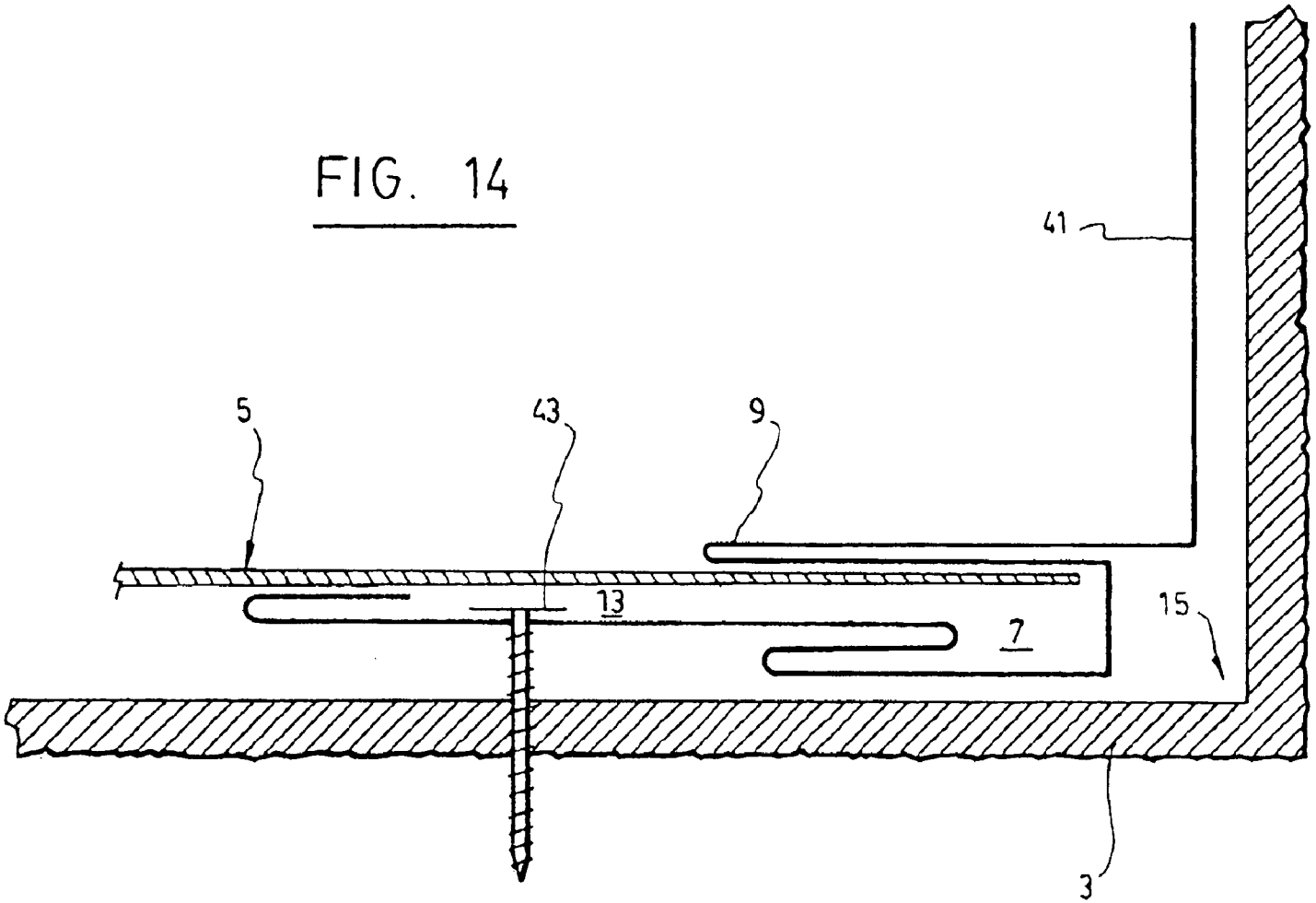
FIG. 14 is a cross-sectional view of a flashing structure according to yet another preferred embodiment of the present invention, said flashing structure being shown mounted onto a roof structure and cooperating with a shingle.

FIGS. 12–14 show other embodiments of the flashing structure 1 according to the present invention which include all the features of the invention, namely first and second drainage channels 7, 13, but does not have a nailing flange 39 for example. It is worth noting that the first and second drainage channels 7, 13 may be positioned differently within the flashing structure 1 according to the present invention so long as they are fluidly connected to one another and operate in the manner described herein.

Indeed, as can be now easily understood, an important feature of these particular embodiments of the present invention resides in the additional drainage channel 13 which now becomes the primary drainage channel 7, and the configuration of the slip-lock lip in very close proximity to the underlying primary channel 7. This configuration allows the blocking of the majority of debris from entering the internal drainage channels 7, 13, and the size of the debris that can get through will be washed out with the next rain.

FIG. 14 shows the end-wall flashing 1 according to another embodiment, incorporating the invention, and having all the key elements described in FIG. 5.

Figure 15:
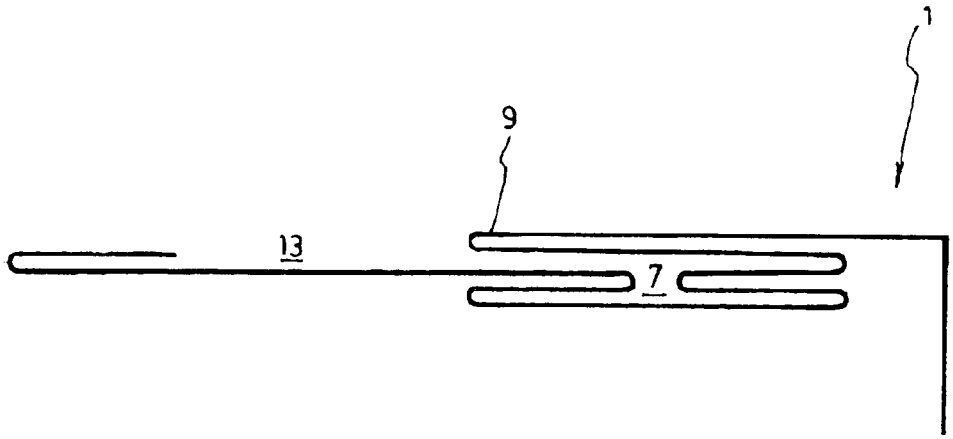
FIG. 15 is a cross-sectional view of a flashing structure according to yet another preferred embodiment of the present invention.
Figure 16:
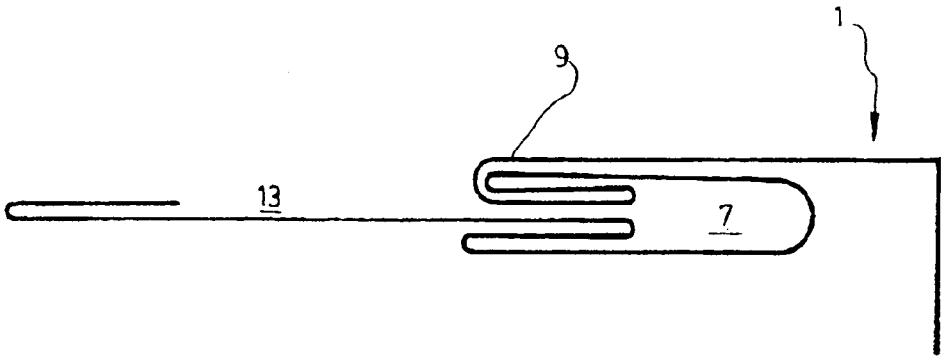
FIG. 16 is a cross-sectional view of a flashing structure according to yet another preferred embodiment of the present invention.

FIGS. 15 and 16 show two cross-sections of a gable-end type of flashing 1 which have different ways of creating the drainage channels 7, 13. In FIG. 15, a second fold has been created to support the shingle 5 or panel, while still creating a drainage channel 13. In FIG. 16, the securing lip 9 has a second fold to provide a tighter joint for the slip lock, and as well creates a more open drainage channel 13.

Figure 17:
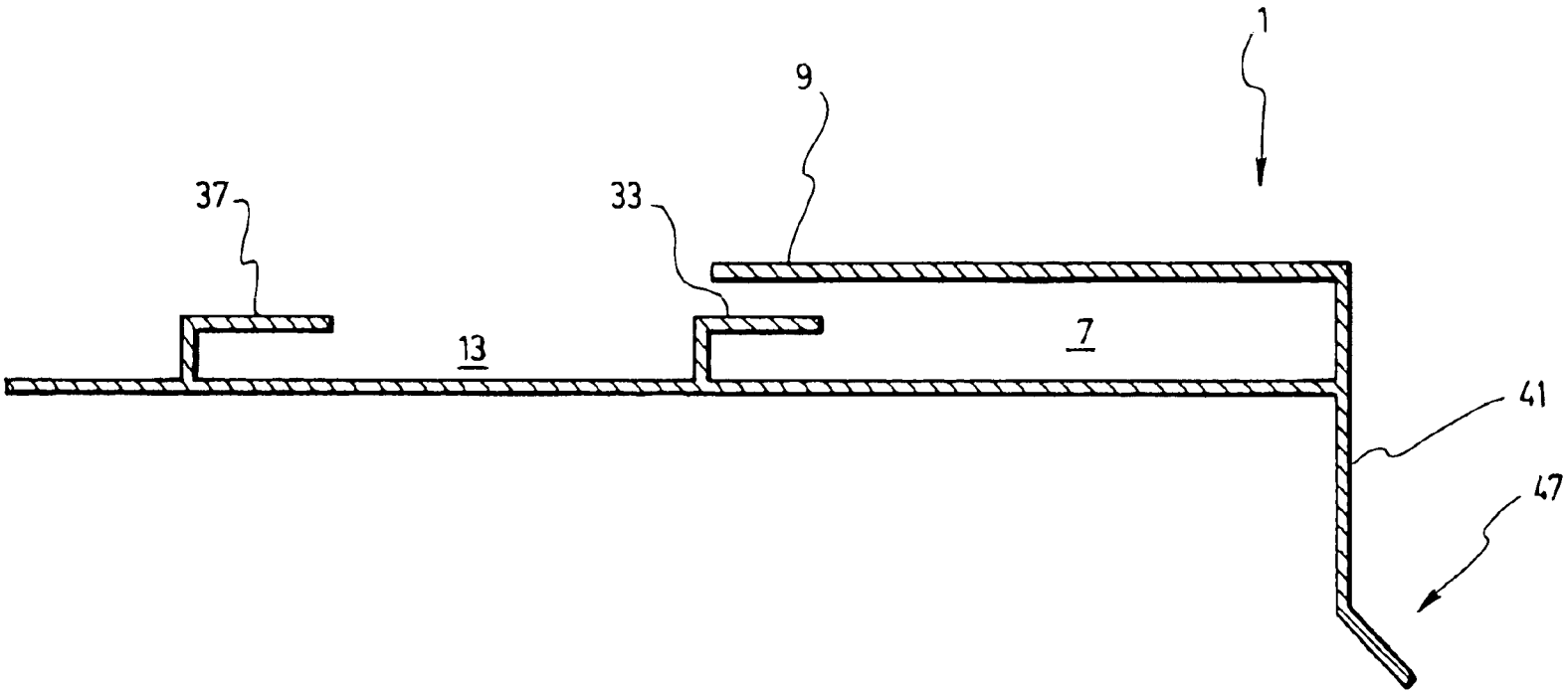
FIG. 17 is a cross-sectional view of a flashing structure according to yet another preferred embodiment of the present invention.

These additional variations on the basic hidden drainage channels 7, 13 can be produced to satisfy specific technical conditions, and are considered variations on the basic invention. Indeed, according to the present invention, the incorporation of the hidden drainage channel in the slip-lock form of the flashing 1 allows for both fast and easy installation, and assurance that water diversion caused by either debris accumulation, or icing conditions does not occur. It is worth mentioning that there are several other ways such a hidden channel can be formed. Two such methods are shown in FIGS. 15 and 16. as discussed previously. Furthermore, FIG. 17 shows a cross-sectional view of a gable-end flashing 1 having been fabricated as an extrusion.

As may now he appreciated, the creation of a hidden drainage channel 13 in roofing flashings 1 according to the present invention allows for easy installation and give a higher level of security and protection than existing methods and practice. Furthermore, the addition of a hidden securing lip on the fascia side of the gable-end flashing 1 provides for a much more secure method of fastening the outside edge of this type of flashing compared to existing methods, while at the same time addressing esthetic concerns. This method is also applicable to any flashing which has a fascia-face exposure, such as the starter flashing.

As may now also be appreciated, the roof flashing 1 incorporates a drainage channel hidden underneath a securing locking lip 9, and a hidden locking lip for the exposed portion of the flashing. This design is adapted with these features to various flashings used in the metal roofing industry, including, but not limited to gable-end flashings 1, end-wall flashings 1, and valley flashings 1, and all other related flashing structures.

As explained hereinabove, key advantages of the flashing according to the present invention are a much easier installation of shingles 5 compared to traditional methods; a hidden channel allowing drainage 13 even under severe weather conditions, unlike traditional flashing systems which can back up and allow water infiltration; and a hidden locking edge preventing wind uplift, thereby allowing system to resist wind damage for all but the most exceptional cases.

The present invention is applicable to the installation of roofing shingles 5 and roofing panels on residential and commercial property roofs. The shingles 5 and panels will usually be metal (e.g, steel, aluminum, copper, etc.), although other suitable materials may be used, such as polymers and/or composites for example, as apparent to a person skilled in the art.

The present invention addresses the ease of installation with a design that allows the slip-lock method of securing the shingles 5 or panels to the flashing, while at the same time providing hidden drainage channels 7, 13 that traps any water infiltration and drains it away.

According to the present invention, the flashing system design for roofing applications incorporates interconnected and concealed drainage channels 7, 13 located underneath a securing locking lip 9, and may be adapted to various flashings 1 used in the roofing industry, including, but not limited to gable-end (or rake) flashings; end-wall flashings; and valley flashings.

The current invention addresses the ease of installation with a design that allows the slip-lock method of securing the shingles or panels to the flashing, while at the same time providing several hidden drainage channels 7, 13 that trap any water infiltration and drain it away.

The invention couples the ease-of-installation of the slip-lock method, with the creation of several built-in drainage channels 7, 13 in a one-piece flashing 1 that will avoid the problems associated with blockage of water flow by debris, and will continue to function reliably even under the harsh conditions of winter. There are different ways of creating such channels, and several examples are illustrated in the enclosed drawings.

As may now be appreciated, the present invention is a substantial improvement over the prior art in that the flashing structure 1, by virtue of its design, enables for a much easier and reliable installation of shingles 5 when compared to traditional methods. Indeed, the preferred one-piece flashing 1 according to the present invention is designed so as to simplify installation because it reduces the number of parts that need to be handled. Moreover, the present invention is also advantageous in that the main first drainage channel 7 is devised to allow a drainage even under severe weather conditions, unlike traditional flashing systems which can back-up and allow water infiltration to the roof. Moreover, the present invention is also advantageous in that the addition of a secondary drainage channel 13 acts as a back-up to the primary first drainage channel 7 in case of extreme water flow rates resulting from precipitation. Furthermore, the present invention is also an improvement over the prior art in that, as explained herein, the flashing structure 1 is so constructed so as to impede the entry of debris into the hidden channels, allowing them to function without danger of blockage. Moreover, unlike previous designs, the present invention is also a substantial improvement over the prior art in that its features may be integrated to various different types of flashing designs, namely valley, gable-end, end-wall, and other related types of flashings 1. Moreover, the flashing structure 1 according to the present invention is also advantageous in that the extended runs of flashing are easily connected to one another using a sequential insertion joining method.

Of course, numerous modifications could be made to the above-described embodiments without departing from the scope of the invention as defined in the appended claims.

What is claimed is:

1. A flashing structure for mounting onto a roof surface and used for receiving at least one shingle, the flashing structure comprising:

first drainage channel extending longitudinally along the flashing structure, the first drainage channel comprising a channel floor having opposite first and second longitudinal edges, the first and second longitudinal edges of the first drainage channel being each provided with a bend;

a first supporting lip being operatively connected to the channel floor of the first drainage channel via the bend provided on the second longitudinal edge thereof;

a second drainage channel extending longitudinally along the flashing structure, the second drainage channel comprising a channel floor having opposite first and second longitudinal edges, the second drainage channel being fluidly connected to the first drainage channel; and a securing lip operatively connected to the channel floor of the first drainage channel via the bend provided on the first longitudinal edge thereof, the securing lip being positioned over the first drainage channel and extending along the same, a gap being defined between the securing lip and the bend provided on the first longitudinal edge of the channel floor of the first drainage channel, said gap being shaped and sized for receiving said at least one shingle.

2. A flashing structure according to claim 1, wherein the second longitudinal edge of the channel floor of the second drainage channel is provided with a bend.

3. A flashing structure according to claim 2, wherein the flashing structure comprises a second supporting lip, said second supporting lip being operatively connected to the channel floor of the second drainage channel via the bend provided on the second longitudinal edge thereof.

4. A flashing structure according to claim 3, wherein the first longitudinal edge of the channel floor of the second drainage channel is operatively connected to the second longitudinal edge of the channel floor of the first drainage channel via the first supporting lip.

5. A flashing structure according to claim 3, wherein the second supporting lip is provided with a nailing flange.

6. A flashing structure according to claim 1, wherein the flashing structure is provided with fastening means for fastening the flashing structure onto the roof surface.

7. A flashing structure for mounting onto a roof surface and used for receiving at least one shingle, the flashing structure comprising:

a first drainage channel extending longitudinally along the flashing structure, the first drainage channel comprising a channel floor having opposite first and second longitudinal edges, the first and second longitudinal edges of the first drainage channel being each provided with a bend;

a first supporting lip being operatively connected to the channel floor of the first drainage channel via the bend provided on the second longitudinal edge thereof;

a securing lip operatively connected to the channel floor of the first drainage channel via the bend provided on the first longitudinal edge thereof, the securing lip being positioned over the first drainage channel and extending along the same, a gap being defined between the securing lip and the supporting lip, said gap being shaped and sized for receiving said at least one shingle;

a second drainage channel extending longitudinally along the flashing structure, the second drainage channel comprising a channel floor having opposite first and second longitudinal edges, the first and second longitudinal edges of the second drainage channel being each provided with a bend, the second drainage channel being fluidly connected to the first drainage channel; and a second supporting lip being operatively connected to the channel floor of the second drainage channel via the bend provided on the second longitudinal edge thereof, the second supporting lip being provided with a nailing flange.

8. A flashing structure according to claim 7, wherein the securing lip is provided with an abutment flange projecting perpendicularly therefrom.

9. A flashing structure for mounting onto a roof surface and used for receiving at least one shingle, the flashing structure comprising:

a first drainage channel extending longitudinally along the flashing structure, the first drainage channel comprising a channel floor having opposite first and second longitudinal edges, the first and second longitudinal edges of the first drainage channel being each provided with a bend;

a first supporting lip being operatively connected to the channel floor of the first drainage channel via the bend provided on the second longitudinal edge thereof;

a second drainage channel extending longitudinally along the flashing structure, the second drainage channel comprising a channel floor having opposite first and second longitudinal edges, the first and second longitudinal edges of the second drainage channel being each provided with a bend, the bend provided on the second longitudinal edge of the channel floor of the second drainage channel being integral to the bend provided on the second longitudinal edge of the channel floor of the first drainage channel, the second drainage channel being fluidly connected to the first drainage channel; and a securing lip operatively connected to the channel floor of the first drainage channel via the bend provided on the first longitudinal edge thereof, the securing lip being positioned over the first drainage channel and extending along the same, a gap being defined between the securing lip and the bend provided on the first longitudinal edge of the channel floor of the first drainage channel, said gap being shaped and sized for receiving said at least one shingle;

wherein the first supporting lip is positioned, shaped and sized for operatively pressing said at least one shingle against the securing lip, so as to minimize a given space thereinbetween.

10. A flashing structure according to claim 9, wherein the securing lip is provided with an abutment flange projecting perpendicularly therefrom.

11. A flashing structure according to claim 1, wherein the flashing structure is a valley flashing structure used for mounting onto a valley of a root surface and used for receiving at least one shingle, said valley flashing structure comprising:

a pair of first drainage channels extending longitudinally along the valley flashing structure;

a pair of securing lips, each of the securing lips being positioned over a corresponding first drainage channel and extending along the same, a gap being defined between each of the securing lips and sad corresponding first drainage channel, each of the gaps being shaped and sized for receiving at least one shingle; and a pair of second drainage channels extending longitudinally along the valley flashing structure, each of the second drainage channels being fluidly connected to a corresponding first drainage channel.

* * * * *